United States Patent [19]

Yamada et al.

[11] 4,039,401

[45] Aug. 2, 1977

[54] ALUMINUM PRODUCTION METHOD WITH ELECTRODES FOR ALUMINUM REDUCTION CELLS

[75] Inventors: Koichi Yamada; Tadanori Hashimoto; Kazuo Horinouchi, all of Niihama, Japan

[73] Assignee: Sumitomo Chemical Company, Limited, Osaka, Japan

[21] Appl. No.: 658,032

[22] Filed: Feb. 13, 1976

Related U.S. Application Data

[63] Continuation of Ser. No. 511,521, Oct. 3, 1974, abandoned.

[30] Foreign Application Priority Data

Oct. 5, 1973 Japan ..... 48-112589

[51] Int. Cl.[2] ..... C25C 3/06; C25C 7/02; C25C 3/12

[52] U.S. Cl. ..... 204/67; 204/290 R; 204/290 F

[58] Field of Search ..... 204/67, 290 R, 290 F

[56] References Cited

U.S. PATENT DOCUMENTS

| | | | |
|---|---|---|---|
| 3,491,014 | 1/1970 | Bianchi et al. | 204/242 |
| 3,649,485 | 3/1972 | Chisholm | 204/95 |
| 3,701,724 | 10/1972 | Entwisle et al. | 204/290 F |
| 3,706,644 | 12/1972 | Martinsons | 204/98 |
| 3,711,382 | 1/1973 | Anthony | 204/1 R |
| 3,711,397 | 1/1973 | Martinsons | 204/290 F |
| 3,718,550 | 2/1973 | Klein | 204/67 |
| 3,738,918 | 6/1973 | Johnson | 204/290 R |
| 3,930,967 | 1/1976 | Alder | 204/67 |
| 3,960,678 | 6/1976 | Alder | 204/67 |

*Primary Examiner*—F.C. Edmundson

*Attorney, Agent, or Firm*—Stevens, Davis, Miller & Mosher

[57] ABSTRACT

An electrode for aluminum reduction cells wherein an electrode base at least in its portion that is brought into contact with a molten salt bath is coated with a composition comprising at least 50% by weight of electronic conductive oxide ceramics, or said portion of the electrode is made of said composition.

7 Claims, 3 Drawing Figures

ALUMINUM PRODUCTION METHOD WITH ELECTRODES FOR ALUMINUM REDUCTION CELLS

This is a continuation of application Ser. No. 511,521 filed Oct. 3, 1974, now abandoned.

The present invention relates to an electrode for aluminum reduction cells. More particularly, it relates to an electrode, and particularly an anode, for aluminum reduction cells, which is made of or covered with electronic conductive oxide ceramics.

It is known to produce aluminum by molten salt electrolysis of aluminum oxide dissolved in a bath of aluminum sodium fluoride ($AlF_3.3NaF$) or so-called cryolite, by using a carbon anode. This electrolisis is usually conducted at about 900° - 1000° C.

When aluminum is produced by using a carbon anode, the carbon anode is oxidized and consumed by about 330 kg theoretically and about 400 - 450 kg actually per ton of aluminum due to oxygen produced through the decomposition of aluminum oxide. For this reason, it is necessary to continuously adjust the position of the electrode to maintain it at a constant level, and it is also required to replace the anode by a new one before it is completely consumed. These are economical and operational defects.

As an approach to obviate the above-mentioned defects in the carbon electrode, various non-consumable anodes have been recently developed. For example, a method using an oxygen ion-conductive anode consisting mainly of zirconium oxide has been proposed (British Patent Specification No. 1,152,124). This method, however, is disadvantageous in that it requires an apparatus for removing oxygen produced and the operation is complex. A method using an anode consisting of electronic conductive metal oxide containing at least 80% by weight of tin oxide has also been proposed (British Pat. Specification No. 1,295,117). This method is also disadvantageous in that the anode has poor chemical resistance to the molten salt.

It is an object of the present invention to provide a so-called non-consumable electrode which does not react with oxygen produced in molten salt electrolysis of aluminum oxide and which has chemical resistance to the molten salt.

Figure 1:
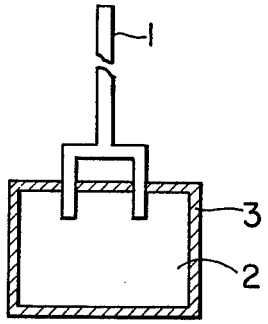
Figure 2:
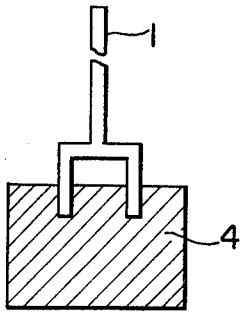
Figure 3:
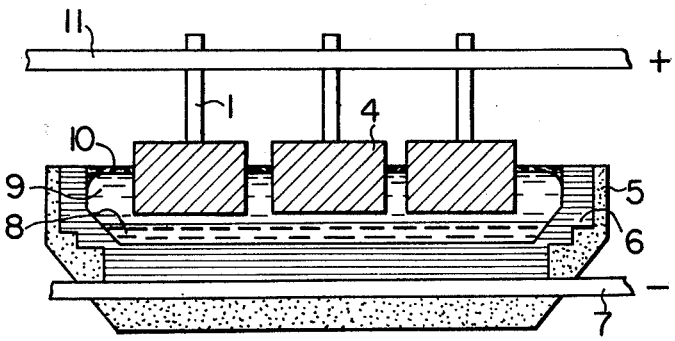

In the accompanying drawings;

FIGS. 1 and 2 show embodiments of the electrodes according to the present invention, and FIG. 3 shows an example of aluminum reduction cells using the electrode of the present invention.

The inventors of the present invention have made extensive investigation to find non-consumable electrodes for molten salt electrolysis of aluminum oxide and have found that spinel structure oxides or perovskite structure oxides have excellent electronic conductivity at a temperature of about 900° - 1000° C, exhibit catalytic action for the generation of oxygen, and exhibit chemical resistance to the molten salt. Based on this finding, they have developed non-consumable electrodes for aluminum electrolytic cells.

According to the present invention, a non-consumable electrode for electrolytic production of aluminum is provided, at least the portion of which, which is brought into contact with a molten salt bath, is made of or covered with a composition containing at least 50% by weight of spinel structure oxide having the general formula $XYY'O_4$ (wherein X is a divalent or tetravalent metal, Y and Y' may be either the same or different and are trivalent or divalent metals, O is oxygen atom, provided that when X is a divalent metal, Y and Y' are selected from trivalent metals but the spinel structure oxides are excluded in which both Y and Y' are trivalent iron, Fe(III), and when X is a tetravalent metal, Y and Y' are selected from divalent metals), or a perovskite structure oxide having the general formula $RMO_3$ (wherein R is a monovalent, divalent or trivalent metal, M is a pentavalent, tetravalent or trivalent metal, O is oxygen atom, provided that when R is a monovalent metal, M is selected from pentavalent metals, and when R is a divalent metal, M is selected from tetravalent metals, and when R is a trivalent metal, M is selected from trivalent metals), or a mixture thereof, said oxides exhibiting chemical durability against the molten salt and having electronic conductivity.

According to the present invention, the electrode base is covered, at least in its portion that is brought into contact with a molten salt, with a composition containing at least about 50% by weight of electronic conductive oxide ceramics selected from spinel structure oxides having the general formula $XYY'O_4$ (wherein X, Y, Y' and O are as defined above), perovskite structure oxides having the general formula $RMO_3$ (wherein R, M and O are as defined above), and a mixture thereof. Alternatively, the above-mentioned part of the electrode may be made of the above-mentioned oxide ceramics.

Usually, in the spinel structure oxides having the general formula $XYY'O_4$, X is a divalent metal such as barium, magnesium, calcium, strontium, zinc, lead copper, molybdenum, manganese, iron, cobalt, nickel or the like, and preferably copper, molybdenum, manganese, iron, cobalt or nickel, or a tetravalent metal such as titanium, vanadium, tin, germanium or the like, and preferably titanium or vanadium, Y and Y' are trivalent metals such as aluminum, gallium, indium, manganese, iron, cobalt, nickel, chromium, vanadium, rhodium, lanthanum, yttrium or the like, and preferably indium, manganese, iron, cobalt, nickel, chromium, rhodium or lanthanum, or divalent metals such as magnesium, zinc, manganese, iron, cobalt, nickel or the like, and preferably iron, cobalt or nickel (provided that when X is a divalent metal, Y and Y' are selected from trivalent metals, and when X is a tetravalent metal, Y and Y' are selected from divalent metals). In the perovskite structure oxides having the general formula $RMO_3$, R is a monovalent metal such as lithium, sodium, potassium or the like, or a divalent metal such as calcium, magnesium, barium, lead or the like, or a trivalent metal such as lanthanum, yttrium, chromium, aluminum, manganese, cobalt, nickel or the like, M is a pentavalent metal such as niobium, tantalum or the like, or a tetravalent metal such as zirconium, titanium, tin or the like, or a trivalent metal such as lanthanum, yttrium, chromium, aluminum, manganese, cobalt, nickel or the like (provided that when R is a monovalent metal, M is selected from pentavalent metals, when R is a divalent metal, M is selected from tetravalent metals, and when R is a trivalent metal, M is selected from trivalent metals). The perovskite structure oxides in which R and M are trivalent metals are preferable.

More particularly, spinel structure oxides such as $MgV_2O_4$, $FeV_2O_4$, $ZnV_2O_4$, $MgCr_2O_4$, $MnCr_2O_4$, $FeCr_2O_4$, $CoCr_2O_4$, $NiCr_2O_4$, $CuCr_2O_4$, $ZnCr_2O_4$, $ZnMn_2O_4$, $MnMn_2O_4$, $FeAlFeO_4$, $MgCo_2O_4$, $CuCo_2O_4$, $ZnCo_2O_4$, $FeNi_2O_4$, $MgRh_2O_4$, $CoRh_2O_4$, $CuRh_2O_4$, $MnRh_2O_4$, $NiRh_2O_4$, $ZnRh_2O_4$, $MgAl_2O_4$, $SrAl_2O_4$, $MoAl_2O_4$, $FeAl_2O_4$, $CoAl_2O_4$, $NiAl_2O_4$, $CuAl_2O_4$, $ZnAl_2O_4$, $MgGa_20_4$, $ZnGa_2O_4$, $CaGa_2O_4$, $MgIn_2O_4$, $MnIn_2O_4$, $FeIn_2O_4$, $CoIn_2O_4$, $NiIn_2O_4$, $MgFeAlO_4$, $NiFeAlO_4$, $CuLa_2O_4$, $CoLa_2O_4$, $NiLa_2O_4$, $TiMg_2O_4$, $TiMn_2O_4$, $TiCo_2O_4$, $TiFe_2O_4$, $TiNi_2O_4$, $TiZn_2O_4$, $SnMg_2O_4$, $SnZn_2O_4$, $SnCo_2O_4$, $VMg_2O_4$ (Note: Although pure spinel such as $MgAl_2O_4$, $SrAl_2O_4$ or $TiMg_2O_4$ has, in general, very small electronic conductivity and it is difficult to use as an electronic conductive material, it may be rendered highly conductive by adding another component thereto. The spinel which has thus been provided with conductivity is conventionally expressed as $MgAl_2O_4$, etc. Therefore, such an expression is also employed in the present invention), or perovskite structure oxides such as $LiNbO_3$, $KNbO_3$, $NaNbO_3$, $LiTaO_3$, $BaTiO_3$, $PbTiO_3$, $PbZrO_3$, $LaCrO_3$, $LaAlO_3$, $LaNiO_3$, $LaYO_3$, $YCrO_3$ or $LaCoO_3$ may be used.

The above-mentioned spinel and/or perovskite structure oxides are of electronic conductor and are different in electro-conductive mode than known ion-conductive electrodes and are also different in crystal structure than the tin oxide electrode, and hence they provide electrodes constructed of completely novel components. The electrodes constructed of such electronic conductive oxide ceramics exhibit excellent conductivity under the electrolysis condition and also have excellent resistance to the molten bath.

The electrodes according to the present invention are made of or covered with a composition containing at least 50% by weight, and preferably at least 70% by weight and most preferably at least 80% by weight, of the said spinel structure oxide, perovskite structure oxide or a mixture thereof at least in their portion that is brought into contact with the molten salt.

In the production of the electrode of the present invention, in order to improve the electrode density, heat resistance, thermal shock resistance, resistance to molten bath and electric conductivity, oxides, carbides, nitrides, borides or silicides of alkali metals, alkaline earth metals, transition metals, platinum group metals, rare earth elements or the like may be added, if necessary, to the electronic conductive oxide ceramics. When the amount of the additive exceeds 50% by weight, however, the electric conductivity, resistance to bath and oxidation resistance of the electrode are deteriorated. Therefore, the amount of the additive should be kept at 50% by weight or less. Particularly preferable additives are transition metal oxides such as manganese oxide, nickel oxide, cobalt oxide and iron oxide, and platinum group metal oxides such as ruthenium oxide, palladium oxide and rhodium oxide, and rare earth element oxides such as yttrium oxide, ytterbium oxide and neodium oxide, and titanium nitride, titanium boride and tungsten silicide.

The optimum electric resistance of the electronic conductive oxide ceramics used in the production of the electrode varies depending on the shape of the electrode such as the thickness of the coating or the like, but usually the material having a conductivity of at least about 0.1 $\Omega^{-1}cm^{-1}$ (at 1000° C) is most preferably used.

The electronic conductive oxide ceramic for coating or forming the electrode of the present invention may have a melting point higher than the operating temperature of the electrolytic cell, and usually higher than about 1000° C and preferably higher than 1200° C.

The electrode of the present invention may be formed from an electrode base made of a conductive material such as a metal or alloy e.g. titanium, nickel or copper, or carbon, graphite, or a carbide, nitride, boride, silicide, titanium, molybdenum or tungsten, on the surface of which a composition containing said oxide ceramics is coated, or the entire electrode may be formed of said oxide ceramics.

In the coating of the oxide ceramics on the electrode base surface, a composition containing the spinel and/or perovskite structure oxide are flame sprayed or plasma sprayed and, if necessary, subjected to heat treatment or electroplating process. Alternatively, an inorganic or organic metal compound, which can produce a spinel and/or perovskite structure oxide upon sintering, is coated, dipped, sprayed or thermal decomposition-evaporated and then thus treated electrode base is sintered. As a further alternative, an electrode base made of an alloy which can produce a spinel and/or perovskite structure oxide upon oxidization or a base coated with such alloy is oxidized. It should be understood that in the coating of the electrode base with the oxide ceramics, an intermediate layer of a platinum group metal oxide or the like may be interposed to enhance the adhasiveness between the oxide ceramics and the base.

The spinel and/or perovskite structure oxides may be conveniently prepared by the firing of a mixture having an appropriate composition of oxides, hydroxides, chlorides, sulfates, nitrates, carbonates, oxalates of said metals usually at a temperature of 500° C or more and preferably at 800° - 2500° C. Sintering is conducted by hot pressing in a high frequency induction furnace or a resistive heating furnace at about 500° C or more and preferably at 800° - 2500° C, and under reduced pressure, atmospheric pressure or elevated pressure, and preferably under a pressure of 50 - 1000 kg/cm$^2$ by hot pressing.

In the application of the electrode of the present invention to the aluminum electrolysis, a connecting means between the electrode and a conductor is not limited but any conventional means may be used. Thus, the connection may be effected by threading, welding or casting, or it may be effected through a low melting point metal such as aluminum, tin or copper, or an alloy or a compound thereof.

The application of the electrode of the present invention to an anode for the production of aluminum will now be described with reference to the accompanying drawings.

FIG. 1 shows an embodiment of the anode according to the present invention. In FIG. 1, a conductive bar 1 is embedded in an anode base formed of a conductive material such as a metal, an alloy, carbon or graphite having a melting point higher than the electrolysis temperature. Applied onto the surface of the anode base 2 by an appropriate method is a coating 3 of the electronic conductive oxide ceramics according to the present invention.

FIG. 2 shows another embodiment of the present invention, in which an anode 4 is entirely formed of the electronic conductive oxide ceramics according to the present invention, in which the conductive bar 1 is embedded.

FIG. 3 shows the running state of an electrolysis of aluminum oxide by the application of the anode of the present invention placed in a reduction cell. The reduction cell comprises a steel outer shell, a thermal insulation 5 of an appropriate insulating material and a lining 6 of a carbonacious material, carbide, boride or the ceramics according to the present invention. A conductive bar 7 is embedded in the lining 6. Molten aluminum 8 precipitates at the bottom of molten electrolyte 9, the top surface of which is covered with a crust 10. The anodes 4 of the present invention suspending from the conductive bar 1 are arranged in the molten electrolyte 9 and appropriately spaced from the surface of the precipitated aluminum. The conductive bar 1 is movably connected with a bus bar 11. In the reduction cell having the above-mentioned structure, aluminum is precipitated when current is introduced.

Although the use of the electrode as an anode is illustrated in FIG. 3, it should be understood that the electrode of the present invention can also be used as a cathode for the aluminum electrolyzer.

The electrode of the present invention has the following advantages over the prior art carbon anode: (1) Since the electrode of the present invention is not consumed unlike the prior art consumable carbon anode, the electrode can be used without replacement for several months or more and usually 0.5 to 1 year. Therefore, the number of times for the electrode replacement can be considerably reduced. (2) Since the electrode of the present invention is not consumed unlike the consumable carbon anode, the frequency of adjusting the distance between the anode and the precipitated aluminum is considerably lowered, thereby the electrolysis operation is simplified, the production cost is reduced and erroneous operation of operators is avoided.

The present invention is illustrated by referring to the following examples, in which parts are by weight unless otherwise indicated.

EXAMPLE 1

Mixed oxide powder consisting of 62.3 parts of chromic oxide, 35.7 parts of cobaltous oxide, and 2 parts of nickel monoxide was dry-mixed in a ball mill for 15 hours and formed under pressure (1000 kg/cm$^2$) by a rubber press, and then sintered in a high frequency induction furnace at 1800° C for two hours to produce an electrode consisting mainly of the spinel structure oxide of $CoCr_2O_4$. The sintered anode was rigid and compact and exhibited a conductivity of 1.0 $\Omega^{-1}$ cm$^{-1}$ at 1000° C. The anode was then drilled and copper was casted in the drilled hole. The copper was connected with a platinum lead wire to complete the anode for use in the electrolysis.

By the use of the anode formed in this manner, a cryolite bath containing saturated aluminum oxide maintained at 950° C was continuously electrolyzed for 3 months while sequentially adding aluminum oxide at a current density of 1 A/cm$^2$ and at 5.7 volts. The decomposition voltage was 2.2 V, which was close to the theoretical value of 2.1 V (at 950° C), and the overvoltage was small. The current efficiency was 95%, and the corrosion of the anode after the electrolysis was not observed.

EXAMPLE 2

Mixed oxide powder consisting of 60.2 parts of lanthanum oxide, 33.9 parts of chromic oxide, and 5.9 parts of strontium carbonate was dry-mixed in a ball mill for 15 hours and formed under pressure (1000 kg/cm$^2$) by a rubber press and then sintered in a high frequency induction furnace at 1900° C for one hour to produce an electrode consisting mainly of the perovskite structure oxide of $LaCrO_3$. The sintered anode was rigid and compact and exhibited a conductivity of 10 $\Omega^{-1}$cm$^{-1}$ at 1000° C. The anode was then drilled and copper was cast in the drilled hole. The copper was connected with a platinum lead wire to complete the anode for the electrolysis.

By using of the anode thus constructed, aluminum oxide was electrolyzed continuously for three months under the same conditions as in Example 1. The decomposition voltage was 2.2 V, the current efficiency was 95%. No corrosion of the anode after the electrolysis was observed.

EXAMPLE 3

Mixed oxide powder consisting of 32.2 parts of titanium oxide, 64.5 parts of ferrous oxide, 3.3 parts of manganese oxide was dry-mixed in a ball mill for 24 hours and formed under pressure (1000 kg/cm$^2$) by oil hydraulic press, and sintered in a silicon carbide resistor electric furnace at 1400° C for 10 hours to produce an electrode consisting mainly of spinel structure oxide of $TiFe_2O_4$. The sintered anode was rigid and compact and exhibited a conductivity of 1 $\Omega^{-1}$ cm$^{-1}$ at 1000° C. The anode was connected to a platinum lead wire through tin metal to complete the anode for the electrolysis.

By the use of the anode thus formed, cryolite bath containing saturated aluminum oxide maintained at 950° C was continuously electrolyzed for 3 months while sequentially adding aluminum oxide at a current density of 0.9 A/cm$^2$ and at 5.7 V. The decomposition voltage was 2.1 V, which substantially corresponded. to the theoretical decomposition voltage, and the overvoltage was very small. The current efficiency was about 95%. No corrosion of the anode after the electrolysis was observed.

EXAMPLE 4

A mixture consisting of 65.8 parts of lanthanum oxide, 33.7 parts of nickel sesquioxide and 0.5 part of indium oxide and a small amount of water were wet-mixed in a ball mill for 24 hours and then heated in a silicon carbide resistor electric furnace at 1600° C for 10 hours. The sintered product was crushed into particles of 200 mesh or less in size. The particles were then applied onto a titanium substrate by a plasma spray unit. In this manner, an anode for the electrolysis having a coating consisting mainly of the perovskite structure oxide of $LaNiO_3$ on the titanium substrate was prepared.

By the use of the anode thus formed, cryolite bath containing saturated aluminum oxide was continuously electrolyzed for 3 months, while sequentially adding aluminum oxide, at a current density of 0.9 A/cm$^2$ and at 5.7 V. The decomposition voltage measured substantially corresponded to the theoretical decomposition voltage. The current efficiency was 95%. Neither corrosion nor strip-off of the anode coating was observed.

EXAMPLE 5

Mixed oxide powder consisting of 20 parts of yttrium oxide, 48 parts of chromic oxide, 22 parts of cobaltous oxide and 10 parts of nickelous oxide was dry-mixed in a ball mill for 15 hours and formed under pressure (1000 kg/cm$^2$) by a rubber press, and then sintered in a high frequency induction furnace at 1800° C for 2 hours. The sintered product was crushed into particles of 200 mesh or less in size in a ball mill. A titanium substrate was plated with palladium in an alkaline aqueous solution containing palladium chloride by passing a current of 0.2 A/cm$^2$ for ten minutes. The plated surface was subjected to oxidation treatment at 600° C for 30 minutes. On the titanium substrate having the surface coating of palladium oxide thereon, the spinel and perovskite structure oxides powder of $CoY_2O_4$, $CoCr_2O_4$, $NiCr_2O_4$ and $YCrO_3$ as prepared above were applied by a plasma spray unit to complete the anode for the electrolysis.

Using the anode thus formed, the aluminum oxide was continuously electrolyzed for 3 months under the same conditions as in Example 4. The decomposition voltage was 2.2 V, and the current efficiency 95%. Neither corrosion nor strip-off of the anode after the electrolysis was observed.

EXAMPLE 6

Mixed oxide powder consisting of 14.0 parts of titanium nitride, 55.5 parts of chromic oxide, 20.5 parts of cobaltous oxide and 10.0 parts of nickelous oxide was dry-mixed in a ball mill for 24 hours and formed under pressure (1000 kg/cm$^2$) into a shape as shown by 6 in FIG. 3 by a rubber press. It was then sintered in a high frequency induction furnace at 1800° C for 2 hours to prepare a cathode consisting mainly of the spinel structure oxides of $CoCr_2O_4$ and $NiCo_2O_4$. The sintered cathode was then drilled and copper was casted and connected with a titanium bar to complete the cathode for the electrolysis.

By the use of the cathode thus formed and a carbon anode, a cryolite bath containing saturated aluminum oxide maintained at 950° C was electrolyzed continuously for 3 months while sequentially adding aluminum oxide and periodically replacing the anode graphite, at a current density of 1 A/cm$^2$ and at 4.7 V. No corrosion of the cathode by electrolyte bath and molten aluminum was observed.

What is claimed is:

1. A method for producing aluminum by molten salt electrolysis of aluminum oxide which comprises electrolyzing aluminum oxide dissolved in a molten salt containing aluminum sodium fluoride as the main component by passing a direct current through an anode to a cathode disposed in said molten salt, wherein at least a portion of said anode and said cathode that is brought into contact with said molten salt is made or covered with a composition containing at least about 50% by weight of electronic conductive oxide ceramics having chemical resistance to the molten salt, said oxide ceramics being selected from spinel structure oxides having the general formula $XYY'O_4$ (wherein X is a divalent or tetravalent metal, Y and Y' may be either the same or different and are trivalent or divalent metals, O is oxygen atom, provided that when X is a divalent metal, Y and Y' are selected from trivalent metals but the spinel structure oxides are excluded in which both Y and Y' are trivalent iron, Fe(III), and when X is tetravalent metal, Y and Y' are selected from divalent metals), perovskite structure oxides having the general formula $RMO_3$ (wherein R is a monovalent, divalent or trivalent metal, M is a pentavalent, tetravalent or trivalent metal, O is oxygen atom, provided that when R is a monovalent metal, M is selected from pentavalent metals, when R is divalent metal, M is selected from tetravalent metals, and when R is a trivalent metal, M is selected from trivalent metals), or a mixture thereof.

2. A method according to claim 1 wherein the electrode is coated with a composition containing at least about 50% by weight of said electronic conductive oxide ceramics at least in its portion that is brought into contact with the molten salt bath.

3. A method according to claim 1 wherein the electrode is made of a composition containing at least about 50% by weight of said electronic conductive oxide ceramics at least its portion that is brought into contact with molten salt bath.

4. A method according to claim 1 wherein said electrode is formed of a composition containing at least 70% by weight of said electronic conductive oxide ceramics.

5. A method according to claim 1 wherein the electrical conductivity of said electronic conductive oxide ceramics is at least 0.1 $\Omega^{-1}$ cm$^{-1}$ (at 1000° C).

6. A method according to claim 1 wherein the melting point of said electronic conductive oxide ceramics is at least 1200° C.

7. A method according to claim 1 wherein said electronic conductive oxide ceramics is selected from spinel structure oxides including $CoCr_2O_4$, $TiFe_2O_4$, $CoY_2O_4$, $NiCr_2O_4$ and $NiCo_2O_4$, perovskite structure oxides including $LaCrO_3$ and $LaNiO_3$ and a mixture thereof.

* * * * *

UNITED STATES PATENT AND TRADEMARK OFFICE

CERTIFICATE OF CORRECTION

PATENT NO. : 4,039,401

DATED : August 2, 1977

INVENTOR(S) : Koichi YAMADA et al.

It is certified that error appears in the above-identified patent and that said Letters Patent are hereby corrected as shown below:

Claim 1, line 7, change "and" to --or--.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*